United States Patent [19]

Sepulveda et al.

[11] 4,295,845

[45] Oct. 20, 1981

[54] PRETREATMENT COMPOSITION FOR STAIN REMOVAL

[75] Inventors: Ralph R. Sepulveda, Suffern, N.Y.; Lynn H. Lander, Harrington Pk., N.J.

[73] Assignee: Lever Brothers Company, New York, N.Y.

[21] Appl. No.: 151,227

[22] Filed: May 19, 1980

Related U.S. Application Data

[62] Division of Ser. No. 49,774, Jun. 18, 1979.

[51] Int. Cl.[3] ..... C11D 3/46; C11D 7/26; D06L 1/02; D06L 1/22

[52] U.S. Cl. ..... 8/139.1; 8/137; 8/139; 252/89.1; 252/162; 252/170; 252/174.21; 252/174.22

[58] Field of Search ..... 8/137, 139, 139.1; 252/89.1, 132, 162, 170, 174.21, 174.22, DIG. 1

[56] References Cited

U.S. PATENT DOCUMENTS

| | | | |
|---|---|---|---|
| 2,462,758 | 2/1949 | Malkemus | 252/554 |
| 2,528,136 | 10/1950 | Goldstein | 252/132 X |
| 3,533,955 | 10/1970 | Pader | 252/153 |
| 3,557,006 | 1/1971 | Ferrara | 252/117 |
| 3,915,633 | 10/1975 | Ramachandran | 8/137 |
| 3,943,234 | 3/1976 | Roggenkamp | 252/143 |
| 4,176,080 | 11/1979 | Wise | 252/162 |

*Primary Examiner*—Dennis L. Albrecht

*Attorney, Agent, or Firm*—James J. Farrell; Melvin H. Kurtz

[57] ABSTRACT

A method and compositions for pre-laundering treatment of fabrics for stain removal are disclosed. The compositions comprise 25–100% of an ester of a short chain alcohol and a fatty acid and 0–75% of a surfactant.

4 Claims, No Drawings

PRETREATMENT COMPOSITION FOR STAIN REMOVAL

This is a divisional application of Ser. No. 49,774 filed June 18, 1979.

This invention applies to the field of compositions for the pretreatment of heavily soiled areas of textiles prior to regular washing. Many textile articles are not uniformly soiled; examples are tablecloths, pants' knees and collars and cuffs on men's shirts. If a suitable pretreatment is applied to the badly stained areas, better results can be obtained for the wash in general with less use of the detergent product. Especially difficult is finding a suitable pretreatment for the removal of greasy stains from fabrics such as polyesters.

Hydrophilic fibers, such as cotton, have a preferential affinity for water over oil. During laundering, water displaces oily soil from the surface of the fabric, causing the soil to "roll-up;" the soil is then more readily removed by mechanical action. Polyester fibers, such as those made from the copolymer of ethylene glycol and terephthalic acid, do not have this preferential affinity for water, but rather, are hydrophobic. Blends of polyester and cotton also exhibit hydrophobic tendencies. Due to this lack of affinity between fiber and water, ordinary laundering often does not satisfactorily remove oily soils from polyester-containing fibers.

The use of certain types of materials for pretreatment is known to the art. U.S. Pat. No. 3,431,060 discloses a composition with a synthetic detergent and an optical brightener dispensed in aerosol form using a suitable propellant. The active is broadly disclosed as being a nonionic, anionic or cationic surfactant.

U.S. Pat. No. 3,417,023 discloses a pretreatment stick containing a gel-forming soap, a synthetic detergent and an optical brightener. The detergent is again broadly disclosed.

U.S. Pat. No. 3,915,633 discloses a pre-wash composition containing an organic complexing acid and a nonionic or anionic surfactant. Among the sample nonionics mentioned are the esters polyglycerol monolaurate and glycol dioleate. No example is given using either ester.

Certain organic esters are known to be cleaning aids. U.S. Pat. No. 2,251,691 discloses partial esters of polyglycerol and fatty acids as being useful in dry cleaning. U.S. Pat. No. 2,251,694 discloses an ester of a hydroxycarboxylic acid and a fatty acid as being useful in dry cleaning. The alkyl esters of fatty acids are disclosed by U.S. Pat. No. 1,875,530 as being useful ingredients of cosmetics. Polyethylene glycol esters of fatty acids are disclosed as having surfactant properties by U.S. Pat. No. 2,528,136.

U.S. Pat. No. 2,462,758 discloses a detergent composition consisting essentially of sulfate or sulfonated anionic surfactant and an monohydric alcohol or glycol ester. The ester is added to the composition in order to improve foaming characteristics.

SUMMARY OF THE INVENTION

It is an object of the present invention to provide a laundry pretreatment composition which will provide effective stain removal on polyester containing fibers.

It is also an object of this invention to provide a laundry pretreatment composition which will effectively remove greasy-oily soils.

Still other objects and advantages of the present invention will become apparent from the instant specification.

It has now been found that the above objects may be accomplished by the use of a pretreating composition comprising as an active system, about 25%–100% of an ester of a short chain alcohol and a fatty acid, about 0–75% of a nonionic surfactant and about 0–50% of an anionic surfactant. In a preferred embodiment the composition is non-aqueous and contains 50–90% ester and 10–50% of a surfactant.

DETAILED DESCRIPTION OF THE INVENTION

The instant invention provides for a method of treating stained fabric prior to laundering by contacting said fabric with a composition which comprises about 25% to about 100% of an ester of a short chain alcohol and a fatty acid, 0 to about 75% of a nonionic surfactant, and 0 to about 50% of an anionic surfactant.

The esters encompassed by this invention are well known to the art. They are formed of alcohols containing 1 to about 4 carbon atoms and having one or more hydroxyl groups and fatty acids containing about 8 to about 22 carbon atoms, saturated or unsaturated, branched or straight chain. Fatty acid di-esters of the polyalkylene glycols, such as polyethylene glycol and polypropylene glycol, may also be used. These are nonionic in nature but have no surface active properties. Among the esters contemplated are:

(1) Esters of monohydric alcohols of the formula R-OH, wherein R is an alkyl radical; such as isopropyl myristate, isopropyl palmitate, butyl stearate, butyl oleate, ethyl stearate, isopropyl isostearate and methyl laurate (2) Glycerol esters such as glycerol monolaurate, glycerol mono- and di-oleate, and glycerol monostearate; also the corresponding esters of polyglycerol;

(3) Glycol esters such as ethylene glycol mono- and di-stearate, diethylene glycol distearate; and mixtures thereof;

(4) Polyethylene glycol esters such as PEG di-stearate.

Mixtures of the above esters may also be used, including esters produced by the reaction of alcohols with fatty acid groups, such as coconut oil or tallow fatty acids.

The amount and type of surfactant to be used in conjunction with the ester for maximum stain removal will depend on the type of stain and the type of fabric. In some applications, 100% ester is desirable; in others a 50/50 mixture gives optimal results. Active compositions comprising about 25% to about 90% ester, along with 0 to about 60% anionic surfactant and 0 to about 75% nonionic surfactant are preferred for use where the range of fabrics treated will be broad, encompassing synthetics and synthetic/cotton blends.

The nonionic surface-active agents useful in this invention include those normally used in detergent compositions. Among these are:

(1) Polyoxyethylene condensates of alkyl phenols containing 6–12 carbon atoms in a straight or branched chain, and 2–25 E.O. units per molecule. Commercial surfactants of this type are the Igepals and Tritons.

(2) Condensation products of aliphatic alcohols containing 8–22 carbon atoms in a straight or branched chain with ethylene oxide, 3–15 E.O. units per molecule. Examples are the Tergitols and Neodols.

(3) Condensation products of ethylene oxide with the reaction products of propylene oxide and diamine. Examples are the Tetronics.

(4) Condensation products of ethylene oxide with the reaction product of propylene oxide and propylene glycol. Examples are the Pluronics.

(5) Amine oxide surfactants having the formula $R_1R_2R_3N \rightarrow O$ wherein $R_1$ and $R_2$ are $C_1$–$C_3$ alkyl groups and $R_3$ is a $C_8$–$C_{22}$ alkyl with 0–2 hydroxyl groups.

(6) Phosphine oxide surfactants of the formula $R_1R_2R_3P \rightarrow O$ wherein $R_1$, $R_2$ and $R_3$ are as defined above.

(7) Sulfoxide surfactants of the formula $$R_3-\overset{\overset{\displaystyle O}{\|}}{S}-R_2,$$

wherein $R_3$ and $R_2$ are as defined above.

The anionic surface-active agents which may be used are those commonly found in detergent products. Included are:

(1) The "soaps," alkali metal, ammonium and alkyl ammonium salts of $C_8$–$C_{22}$ fatty acids;

(2) alkali metal and ammonium salts of organic sulfuric reactions products containing an alkyl radical having 8 to 22 carbon atoms. Examples are the alkyl sulfates, the alkyl sulfonates, and the alkyl benzene sulfonates;

(3) the olefin sulfonates having 8–22 carbon atoms;

(4) the alkyl glyceryl ether sulfonates having 8–22 carbon atoms;

(5) alkali metal salts of fatty acid monoglyceride sulfates and sulfonates;

(6) alkali metals salts of alkylphenol ethylene oxide ether sulfates, containing 1–12 E.O. units per molecule and 8–22 carbon atoms in the alkyl chain;

(7) the fatty acid isethionates;

(8) the alkyl ether sulfates having 1–30 E.O. units per molecule and an alkyl or alkenyl unit of 8–22 carbon atoms;

(9) salts of a fatty acid amide of a methyl tauride.

Nonionic surfactants are preferred for the compositions of this invention and may be used at levels up to about 75%. Anionic surfactants are less effective in these compositions, but can still be used at levels up to about 60%. In addition, the combinations of anionics and esters showed a tendency to separate in many cases, and were therefore less suitable for commercial application.

Mixtures of the various surfactants herein described may also be used.

In addition to the surfactant/ester system, the pretreatment composition may contain other adjuvants known to the detergent art such as builders, bleaches, and optical brighteners. Other materials to ease dispensing may also be added. If the product is to be used in stick form, firming agents such as clays may be used; if it is to be dispensed as an aerosol, a propellant may be added.

In its most preferred form, the composition comprises about 50–90 ester, 0 to about 50% nonionic surface-active agent and 0 to about 50% anionic surface-active agent, the total surfactant being about 10% to about 50%. The preferred compositions contain little or no water, since added water can hasten hydrolysis of the ester, or separation of the surfactant and ester.

The preferred esters for use in the compositions are esters formed of alcohols of the formula R—OH wherein R is an alkyl radical, with fatty acids; isopropyl myristate and butyl stearate particularly preferred. The preferred surfactants are nonionics with ethylene oxide condensates of primary and secondary alcohols having 11–15 carbon atoms and 3–5 E.O. units per molecule particularly preferred.

The following examples serve to illustrate the invention. All proportions are by weight.

In the following examples, the procedure for determining stain removal is as follows:

65/35 Dacron/cotton (D/C) and single knit polyester swatches are stained with 3 and 5 drops of dirty motor oil, respectively, and the oil is allowed to be absorbed into the cloth for one hour. The result of the staining procedure is swatches with stains of approximately equal size. The reflectance of each swatch is then measured with a Gardner Reflectance Spectrophotometer, Model No. XL-10, CDM. The stained swatches are treated by dropping a specified amount of a pretreatment composition on each stain, and adding two swatches to a pot containing 1 liter of a standard detergent solution. The detergents, described below, and made up with 180 ppm (unless otherwise specified) hardness water ($Ca^{++}:Mg^{++}=2:1$). The swatches are agitated in this detergent solution at 120° F. for 10 minutes, rinsed for one minute in fresh 180 ppm, 120° F. water, and dried in a commercial clothes dryer. A final reflectance value is then measured. Detergency is calculated by subtracting the initial average reflectance of the soiled cloth before pretreatment from the reflectance of the cloth after treating and drying. The % detergency is determined by dividing this detergency number by a number representing the average difference in reflectance between a soiled cloth and a clean cloth. Thus, $$\%\ \text{detergency} = \frac{Ref\,(\text{after washing}) - Ref\,(\text{after soiling})}{Ref\,(\text{before soiling}) - Ref\,(\text{after soiling})} \times 100\%$$

A difference in % detergency between two samples run together of about 5 percentage points should be considered a significant difference.

Two laundry detergents were used to wash the cloths.

Their composition were as follows:

| Detergent A | Weight % |
|---|---|
| Sodium Linear Alkylbenzene Sulfonate ($C_{14}$–$C_{18}$ chain) | 7.4 |
| Sodium Alcohol Sulfate ($C_{14}$–$C_{18}$ chain) | 5.2 |
| Sodium Fatty Alcohol E.O. Sulfate ($C_{12}$–$C_{18}$ chain, 4.7 E.O. Average) | 4.2 |
| Polyethylene Glycol (M.W. = 6000–7500) | 1.6 |
| Sodium Sulfate | 36.6 |
| Sodium Phosphates | 23.2 |
| Sodium Silicate ($SiO_2:Na_2O$ = 2.4) | 10.4 |
| Sodium Carbonate | 3.9 |
| Water | 6.8 |
| Miscellaneous | to 100% |

| Detergent B | Weight % |
|---|---|
| Ethoxylated Primary Alcohol - $C_{14-15}$ Chain | |

-continued

| | |
|---|---|
| Length, 13 E.O. Average | 8.9 |
| Sodium Soap | 1.0 |
| Sodium Tripolyphosphate | 30.0 |
| Sodium Silicate ($SiO_2$:$Na_2O$ = 2.4) | 4.5 |
| Sodium Perborate | 2.5 |
| Sodium Sulfate | 43.0 |
| Water | 9.3 |
| Miscellaneous | to 100% |

EXAMPLES 1-5

Test formulations were made up as follows:
ester—isopropyl myristate
surfactant—$C_{11-15}$ secondary alcohol, 3 E.O. (sold by Union Carbide as Tergitol 15-S-3).

| | Ester | Nonionic Surfactant |
|---|---|---|
| 1 | — | 100% |
| 2 | 25% | 75% |
| 3 | 50% | 50% |
| 4 | 75% | 25% |
| 5 | 100% | — |

The detergent solution used in the testing was made from Detergent A. 0.5 grams pretreatment with above mixture per swatch was used.

| Sample | | Det. A conc. g/l | % Detergency D/C | % Detergency Polyester |
|---|---|---|---|---|
| Control | (no pretreatment) | 2.0 | 16.2 | 4.2 |
| 1 | | 1.4 | 28.9 | 24.3 |
| 2 | | 1.4 | 35.8 | 39.2 |
| 3 | | 1.4 | 39.2 | 40.8 |
| 4 | | 1.4 | 37.7 | 33.9 |
| 5 | | 1.4 | 40.8 | 21.6 |

The data show that it is more difficult to remove the stain from polyester than from blends with cotton, probably due to the aforementioned hydrophobic nature of polyester. On polyester, mixtures of nonionic and ester clearly show the greatest detergency. On Dacron/cotton, the ester alone is comparable to the mixtures.

EXAMPLES 6-10

Test formulations were made up as follows:

| | Isopropyl myristate | $C_{11-15}$ sec. alcohol 5 E.O. (Tergitol 15-S-5) |
|---|---|---|
| 6 | — | 100% |
| 7 | 25% | 75% |
| 8 | 50% | 50% |
| 9 | 75% | 25% |
| 10 | 100% | — |

The detergent solution was Detergent A. Pretreatment=0.5 g/swatch.

| Sample | | Det. A g/l | % Detergency D/C | % Detergency Polyester |
|---|---|---|---|---|
| Control | (no pretreatment) | 2.0 | 28.4 | 1.5 |
| 6 | | 1.4 | 20.3 | 13.8 |
| 7 | | 1.4 | 37.3 | 32.3 |
| 8 | | 1.4 | 55.4 | 46.1 |

-continued

| Sample | Det. A g/l | % Detergency D/C | % Detergency Polyester |
|---|---|---|---|
| 9 | 1.4 | 49.2 | 46.5 |
| 10 | 1.4 | 51.3 | 31.8 |

With this formulation peak detergency on polyester cloths appears to be somewhere in the range of 50-75% ester; on Dacron/cotton comparable detergency was found in the 50-100% ester range.

EXAMPLES 11-15

Test formulations:

| | Isopropyl myristate | $C_{11-15}$ sec. alcohol 7 E.O. (Tergitol 15-S-7) |
|---|---|---|
| 11 | — | 100% |
| 12 | 25% | 75% |
| 13 | 50% | 50% |
| 14 | 75% | 25% |
| 15 | 100% | — |

Detergent solution: Detergent A. Pretreatment: 0.5 g/swatch.

| Sample | | Det. A g/l | % Detergency D/C | % Detergency Polyester |
|---|---|---|---|---|
| Control | (no pretreatment) | 2.0 | 28.5 | 3.4 |
| 11 | | 1.4 | 15.9 | 8.1 |
| 12 | | 1.4 | 21.1 | 12.7 |
| 13 | | 1.4 | 31.0 | 32.2 |
| 14 | | 1.4 | 36.8 | 33.1 |
| 15 | | 1.4 | 49.4 | 43.0 |

This surfactant gives poorer detergency than those with less E.O. per molecule. Improvements are found with greater ester concentrations.

EXAMPLES 16-24

The following formulations were made with primary alcohol ethoxylates and isopropyl myristate.

| | Isopropyl myristate | Nonionic |
|---|---|---|
| 16 | — | 100% $C_{12-15}$, 3 E.O. |
| 17 | 25% | 75% $C_{12-15}$, 3 E.O. |
| 18 | 75% | 25% $C_{12-15}$, 3 E.O. |
| 19 | 100% | — $C_{12-15}$, 3 E.O. |
| 20 | — | 100% $C_{12-15}$, 9 E.O. |
| 21 | 25% | 75% $C_{12-15}$, 9 E.O. |
| 22 | 50% | 50% $C_{12-15}$, 9 E.O. |
| 23 | 75% | 25% $C_{12-15}$, 9 E.O. |
| 24 | 100% | — $C_{12-15}$, 9 E.O. |

The $C_{12-15}$, 3 E.O. surfactant is sold by Shell as Neodol 25-3; the $C_{12-15}$, 9 E.O. surfactant is Neodol 25-9.
The detergent solution is Detergent A.

| Sample | Pretreatment g/swatch | Det. A g/l | % Detergency D/C | % Detergency Polyester |
|---|---|---|---|---|
| 16 | .75 | 1.36 | 32.0 | 37.9 |
| 17 | .50 | 1.36 | 34.2 | 36.3 |
| 18 | .50 | 1.36 | 39.9 | 49.2 |
| 19 | .75 | 1.36 | 50.5 | 35.2 |
| Control | (no pretreatment) | 2.0 | 22.8 | 3.4 |

-continued

| Sample | Pretreatment g/swatch | Det. A g/l | % Detergency D/C | Polyester |
|---|---|---|---|---|
| 20 | .50 | 1.4 | 10.1 | 16.7 |
| 21 | .50 | 1.4 | 18.2 | 14.2 |
| 22 | .50 | 1.4 | 32.4 | 42.2 |
| 23 | .50 | 1.4 | 48.9 | 50.5 |
| 24 | .50 | 1.4 | 46.1 | 37.4 |

The higher E.O. material again provides poorer detergency, with less ester. At higher ester concentration, the differences between surfactants are small.

EXAMPLES 25–34

The following formulations were made with various esters as indicated, and $C_{11-15}$ secondary alcohol with 5 E.O.

| | Ester Type | Ester % | Nonionic |
|---|---|---|---|
| 25 | Isopropyl myristate/ palmitate blend | — | 100% |
| 26 | Isopropyl myristate/ palmitate blend | 25% | 75% |
| 27 | Isopropyl myristate/ palmitate blend | 50% | 50% |
| 28 | Isopropyl myristate/ palmitate blend | 75% | 25% |
| 29 | Isopropyl myristate/ palmitate blend | 100% | — |
| 30 | Butyl Stearate | — | 100% |
| 31 | " | 25% | 75% |
| 32 | " | 50% | 50% |
| 33 | " | 75% | 25% |
| 34 | " | 100% | — |

Detergent solution: Detergent A. Pretreatment: 0.5 g/swatch.

| | | Det. A g/l | Detergency D/C | Polyester |
|---|---|---|---|---|
| Control | (no pretreatment) | 2.0 | 29.9 | 4.5 |
| 25 | | 1.4 | 20.4 | 17.3 |
| 26 | | 1.4 | 30.8 | 33.5 |
| 27 | | 1.4 | 60.2 | 52.0 |
| 28 | | 1.4 | 53.4 | 55.9 |
| 29 | | 1.4 | 49.3 | 40.5 |
| Control | (no pretreatment) | 2.0 | 31.0 | 4.9 |
| 30 | | 1.4 | 19.9 | 16.4 |
| 31 | | 1.4 | 34.5 | 29.0 |
| 32 | | 1.4 | 58.5 | 49.9 |
| 33 | | 1.4 | 41.9 | 36.3 |
| 34 | | 1.4 | 46.0 | 22.1 |

Both esters provide good results and, for a variety of fabrics are best used in proportions of 50–75% with 25–50% nonionic.

EXAMPLES 35–38

Pretreatment was done using butyl stearate as the ester and as surfactant, a condensate of ethylene oxide with hyrophobic bases formed by condensing propylene oxide with propylene glycol, and having an average molecular weight of about 2000 was used. This surfactant is known commerically as BASF-Wyandotte Pluronic L-61, and contains about 10% ethylene oxide.

| Sample | Ester | Surfactant |
|---|---|---|
| 35 | — | 100% |
| 36 | 25% | 75% |
| 37 | 75% | 25% |
| 38 | 100% | — |

| Sample | Pretreatment g/swatch | % Detergency D/C | Polyester |
|---|---|---|---|
| 35 | .75 | 12.1 | 1.8 |
| 36 | .50 | 29.0 | 18.3 |
| 37 | .50 | 36.0 | 35.3 |
| 38 | .75 | 48.9 | 42.7 |

EXAMPLES 39–42

Pretreatment was done with combinations of polyethylene glycol (M.W.=400) dioleate and dimethyl dihydrogentated tallow amine oxide.

| Sample | Ester | Nonionic |
|---|---|---|
| 39 | — | 100% |
| 40 | 25% | 75% |
| 41 | 75% | 25% |
| 42 | 100% | — |

Detergent solution: Detergent A, 1.36 g/l.

| Sample | Pretreatment g/swatch | % Detergency D/C | Polyester |
|---|---|---|---|
| 39 | .75 | 13.3 | 6.5 |
| 40 | .50 | 19.6 | 9.8 |
| 41 | .50 | 35.3 | 31.1 |
| 42 | .75 | 31.3 | 31.5 |

EXAMPLES 43–52

A series of dirty motor oil stains were pretreated with compositions consisting of 25% nonionic, 75% isopropyl myristate, with washes in Detergent A, 120 ppm water. Pretreatment: 0.5 g/swatch. Results were as follows:

| Sample | Nonionic | Det. A g/l | % Detergency D/C | Polyester |
|---|---|---|---|---|
| Control | no pretreatment | 2.0 | 33.0 | 2.3 |
| 43 | Tergitol 15-S-3 | 1.4 | 53.6 | 46.3 |
| 44 | Tergitol 15-S-5 | 1.4 | 57.8 | 52.8 |
| 45 | Tergitol 15-S-7 | 1.4 | 40.6 | 31.1 |
| 46 | Tergitol 15-S-9 | 1.4 | 43.8 | 48.4 |
| 47 | Neodol 25-9 | 1.4 | 46.7 | 48.0 |

Another series of dirty motor oil stains were pretreated with compositions consisting of 75% nonionic and 25% isopropyl myristate, with washes in Detergent A, 120 ppm water. Pretreatment: 0.5 g/swatch. Results are as follows:

| Sample | Nonionic | g/l | % Detergency D/C | Polyester |
|---|---|---|---|---|
| Control | no pretreatment | 2.0 | 26.6 | 6.0 |
| 48 | Tergitol 15-S-3 | 1.4 | 42.2 | 46.0 |
| 49 | Tergitol 15-S-5 | 1.4 | 35.1 | 36.3 |
| 50 | Tergitol 15-S-7 | 1.4 | 20.6 | 15.3 |

-continued

| Sample | Nonionic | g/l | % Detergency D/C | Polyester |
|---|---|---|---|---|
| 51 | Tergitol 15-S-9 | 1.4 | 22.1 | 15.2 |
| 52 | Neodol 25-9 | 1.4 | 25.7 | 21.1 |

With compositions high in nonionic, peak stain removal is obtained with Tergitol 15-S-3, with 15-S-5 also acceptable. With the low-nonionic compositions, Tergitol 15-S-5 is the best performer, although the others were acceptable. Overall stain removal is better with the low-nonionic composition.

EXAMPLES 53–57

Test formulations were made up as follows:

| Sample | Isopropyl Myristate | Anionic |
|---|---|---|
| 53 | 25% | 75% sodium $C_{14}$–$C_{16}$ alpha olefin sulfonate |
| 54 | 75% | 25% sodium secondary alkane sulfonate |
| 55 | 25% | 75% sodium secondary alkane sulfonate |
| 56 | 75% | 25% sodium lauryl hydroxy ether sulfonate |
| 57 | 75% | 25% sodium $C_{10}$ linear alcohol sulfate |

Detergent solution: Detergent B, 1.99 g/l. Pretreatment = 0.5 g/swatch.

| Sample | | % Detergency D/C | Polyester |
|---|---|---|---|
| Control | (no pretreatment) | 35.3 | 7.4 |
| 53 | | 27.6 | 9.9 |
| 54 | | 50.6 | 30.7 |
| 55 | | 29.3 | 8.7 |
| 56 | | 51.4 | 27.4 |
| 57 | | 53.0 | 26.6 |

Sample 55 was a translucent-opaque gel-like viscous paste. All other samples showed some separation, but were readily dispersed upon shaking.

EXAMPLES 58–59

Test formulations were made up as follows:

| | Isopropyl Myristate | Surfactant |
|---|---|---|
| 58 | 50% | 50% Na $C_{10}$ Alcohol Sulfate |
| 59 | 25% | 50% Na $C_{10}$ Linear Alcohol Sulfate |
| — | — | 25% $C_{11}$–$C_{15}$ Sec Alcohol-5 E.O. |

Detergent solution: Detergent B, 1.99 g/l. Pretreatment: 0.5 g/swatch.

| | | % Detergency D/C | Polyester |
|---|---|---|---|
| Control | (no pretreatment) | 36.4 | 2.6 |
| 58 | | 51.6 | 24.5 |
| 59 | | 42.2 | 23.2 |

Compositions containing 75% anionic and 25% ester were generally ineffective. Compositions with 50% anionic were acceptable.

What is claimed is:

1. A method for the pre-laundering treatment of stained fabrics comprising contacting said fabric with an active composition containing little or no water and having little tendency to exhibit separation, said composition comprising at least one ester formed of a fatty acid of about eight to about twenty-two carbon atoms chain length, and (1) an alcohol of one to about four carbon atoms chain length or (2) a polyalkylene glycol which is a polyethylene or polypropylene glycol; and wherein said ester is a di-ester.

2. The method of claim 1 wherein said ester is an ester of a fatty acid and an alcohol of the formula R—OH wherein R is an alkyl radical of one to about four carbon atoms chain length.

3. The method of claim 2 wherein said ester is isopropyl myristate or butyl stearate.

4. A method for the pre-laundering treatment of stained fabrics comprising contacting said stained fabric with an active composition containing little or no water and having little tendency to exhibit separation with an active composition, said composition comprising:

(a) about 25% to about 90% of at least one ester formed of a fatty acid of about eight to about twenty-two carbon atoms chain length, and (1) an alcohol of one to about four carbon atoms chain length or (2) a polyalkylene glycol which is a polyethylene or polypropylene glycol; and wherein said ester is a di-ester;

(b) 0 to about 75% of at least one nonionic surface-active agent; and (c) 0 to about 60% of at least one anionic surface-active agent.

* * * * *